US008627678B2

(12) United States Patent
Choi

(10) Patent No.: US 8,627,678 B2
(45) Date of Patent: Jan. 14, 2014

(54) REFRIGERATOR

(75) Inventor: Sang Phil Choi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 464 days.

(21) Appl. No.: 12/730,283

(22) Filed: Mar. 24, 2010

(65) Prior Publication Data

US 2011/0146323 A1 Jun. 23, 2011

(30) Foreign Application Priority Data

Dec. 22, 2009 (KR) ..... 10-2009-0129254

(51) Int. Cl.
*F25C 5/18* (2006.01)

(52) U.S. Cl.
USPC ..... 62/344; 62/377; 62/66

(58) Field of Classification Search
USPC ..... 62/344, 377, 3.6, 441, 3.62; 292/113, 292/DIG. 71; 312/9.4, 215, 401
See application file for complete search history.

(56) References Cited

U.S. PATENT DOCUMENTS

| | | | | | |
|---|---|---|---|---|---|
| 1,549,422 | A * | 8/1925 | Mohun et al. | ..... | 292/100 |
| 2,534,396 | A * | 12/1950 | Barnes | ..... | 292/113 |
| 5,659,927 | A * | 8/1997 | Shanok et al. | ..... | 16/412 |
| 7,670,018 | B2 * | 3/2010 | Kim et al. | ..... | 362/92 |
| 8,104,800 | B2 * | 1/2012 | Lorek | ..... | 292/108 |
| 2005/0144970 | A1 * | 7/2005 | Cho et al. | ..... | 62/441 |
| 2009/0178429 | A1 * | 7/2009 | Lee et al. | ..... | 62/344 |
| 2010/0126202 | A1 * | 5/2010 | Flores et al. | ..... | 62/344 |
| 2010/0313595 | A1 * | 12/2010 | Seo | ..... | 62/344 |

* cited by examiner

*Primary Examiner* — Cheryl J Tyler
*Assistant Examiner* — Ana Vazquez
(74) *Attorney, Agent, or Firm* — Fish & Richardson P.C.

(57) ABSTRACT

Provided is a refrigerator that includes a cabinet and a refrigerator door. The cabinet defining a storage compartment. The refrigerator door opens and closes the storage compartment. The refrigerator door includes a door liner defining an ice compartment, an ice compartment door opening and closing the ice compartment, and a handle provided to the ice compartment door. The ice compartment door includes a dike protruding from the ice compartment door. The handle and the dike are disposed on an identical line.

16 Claims, 9 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2009-0129254 (filed on Dec. 22, 2009), which is hereby incorporated by reference in its entirety.

BACKGROUND

The present disclosure relates to a refrigerator.

Generally, a refrigerator is an apparatus that stores foods at a low temperature using low temperature air.

The refrigerator includes a cabinet in which a storage compartment is defined and a refrigerator door opening and closing the storage compartment. The storage compartment may include a refrigerator compartment and a freezer compartment. The refrigerator door may include a refrigerator compartment door opening and closing the refrigerator compartment and a freezer compartment door opening and closing the freezer compartment.

Also, the refrigerator may include an ice making assembly that makes ice using cool air to store the made ice. The ice making assembly includes an ice maker generating ice and an ice bin in which ice removed from the ice maker is stored.

SUMMARY

Embodiments provide a refrigerator.

In one embodiment, a refrigerator includes: a cabinet defining a storage compartment; and a refrigerator door configured to open and close the storage compartment, the refrigerator door including a door liner defining an ice compartment; an ice compartment door configured to open and close the ice compartment; and a handle provided to the ice compartment door, wherein the ice compartment door includes a dike protruded from the ice compartment door, and the handle and the dike are disposed on an identical line.

In another embodiment, a refrigerator includes: a cabinet defining a storage compartment; and a refrigerator door configured to open and close the storage compartment, the refrigerator door including a door liner defining an ice compartment; an ice compartment door configured to open and close the ice compartment; and a handle rotatably provided to the ice compartment door, wherein the handle includes a grip part and a hook member extended from the grip part and hung on the door liner, and the ice compartment door includes a guide part guiding a movement of the hook member.

In further another embodiment, a refrigerator includes: a cabinet defining a storage compartment; and a refrigerator door configured to open and close the storage compartment, refrigerator door including a door liner defining an ice compartment; an ice compartment door configured to open and close the ice compartment; and a handle provided to the ice compartment door and including a grip part and a hook member extended from the grip part and hung on the door liner, wherein a rotation center of the handle crosses a side surface of the ice compartment door.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
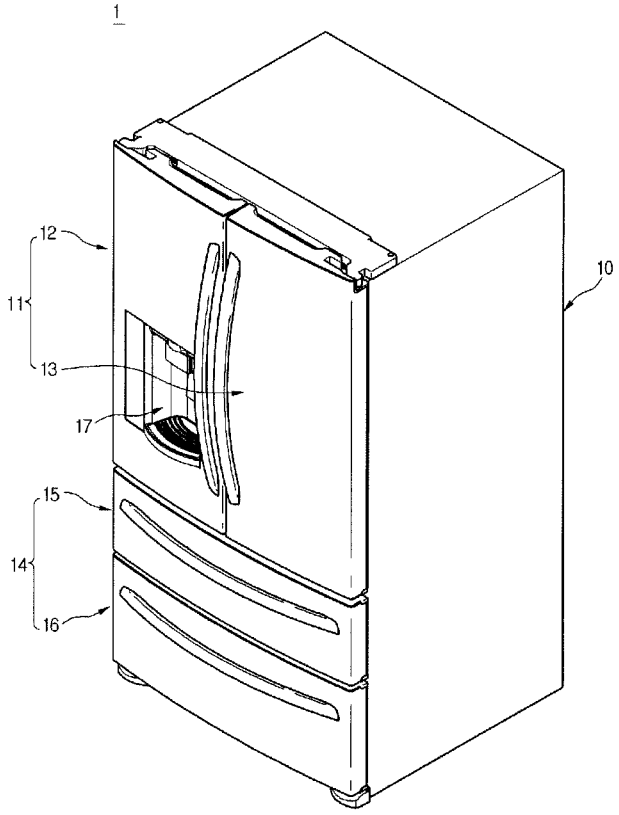
FIG. 1 is a perspective view of a refrigerator according to an embodiment.
Figure 2:
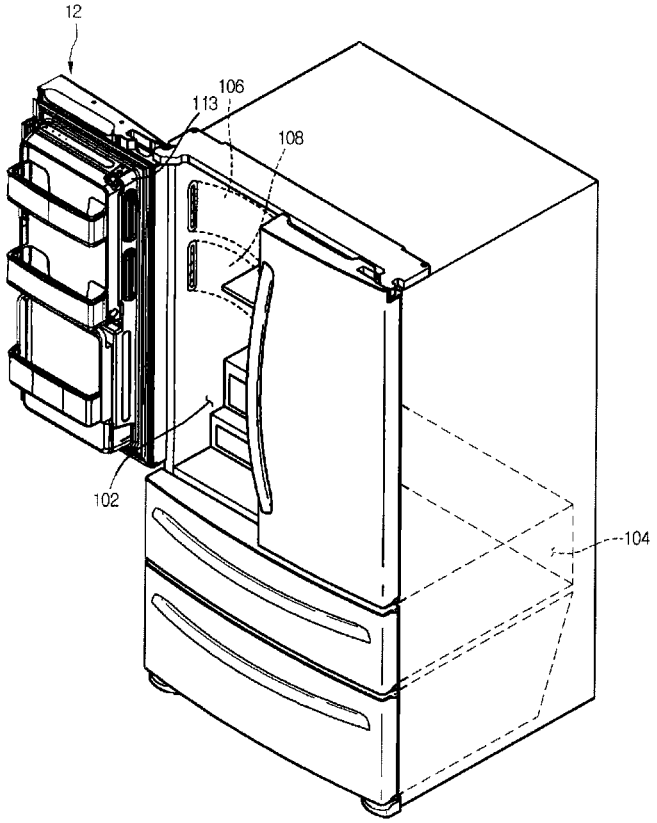
FIG. 2 is a perspective view illustrating a state where a portion of a refrigerator door is opened, according to the embodiment.

FIG. 1 is a perspective view of a refrigerator according to an embodiment. FIG. 2 is a perspective view illustrating a state where a portion of a refrigerator door is opened, according to the embodiment.

Referring to FIGS. 1 and 2, a refrigerator 1 according to the embodiment includes a cabinet 10 defining an outer appearance of the refrigerator 1, and refrigerator doors 11 and 14 movably connected to the cabinet 10.

A storage compartment for storing foods is defined inside the cabinet 10. The storage compartment includes a refrigerator compartment 102 and a freezer compartment 104 disposed below the refrigerator compartment 102.

That is, a bottom freeze type refrigerator in which a refrigerator compartment is disposed above a freezer compartment will be exemplified in the current embodiment.

The refrigerator door 11 and 14 may be respectively referred to as a refrigerator compartment door opening and closing the refrigerator compartment 102, and a freezer compartment door opening and closing the freezer compartment 104.

The refrigerator compartment door 11 includes a plurality of doors 12 and 13 that are disposed at left and right sides, respectively. The doors 12 and 13 include a first refrigerator compartment door that is also denoted by 12 and a second refrigerator compartment door that is also denoted by 13 and disposed at a right side of the first refrigerator compartment door 12. The first refrigerator compartment door 12 may be independently movable with respect to the second refrigerator compartment door 13.

The freezer compartment door 14 includes a plurality of doors 15 and 16 that are vertically arrayed. The doors 15 and 16 include a first freezer compartment door 15 and a second freezer compartment door 16 disposed below the first freezer compartment door 15.

The first and second refrigerator compartment doors 12 and 13 may be rotatably moved, and the first and second freezer compartment doors 15 and 16 may be slidably moved.

A dispenser 17 for dispensing water or ice is disposed in one of the first and second refrigerator compartment doors 12 and 13. For example, the dispenser 17 is disposed in the first refrigerator door 12 in FIG. 1.

Also, an ice making assembly (that will be described later) for generating and storing the ice is disposed in one of the first and second refrigerator compartment doors 12 and 13.

In the current embodiment, the dispenser 17 and the ice making assembly may be disposed in the first refrigerator compartment door 12 or the second refrigerator compartment door 13. Thus, it will be described below that the dispenser 17 and the ice making assembly are disposed in the refrigerator compartment door 11 including the first refrigerator compartment door 12 and the second refrigerator compartment door 13.

Figure 3:
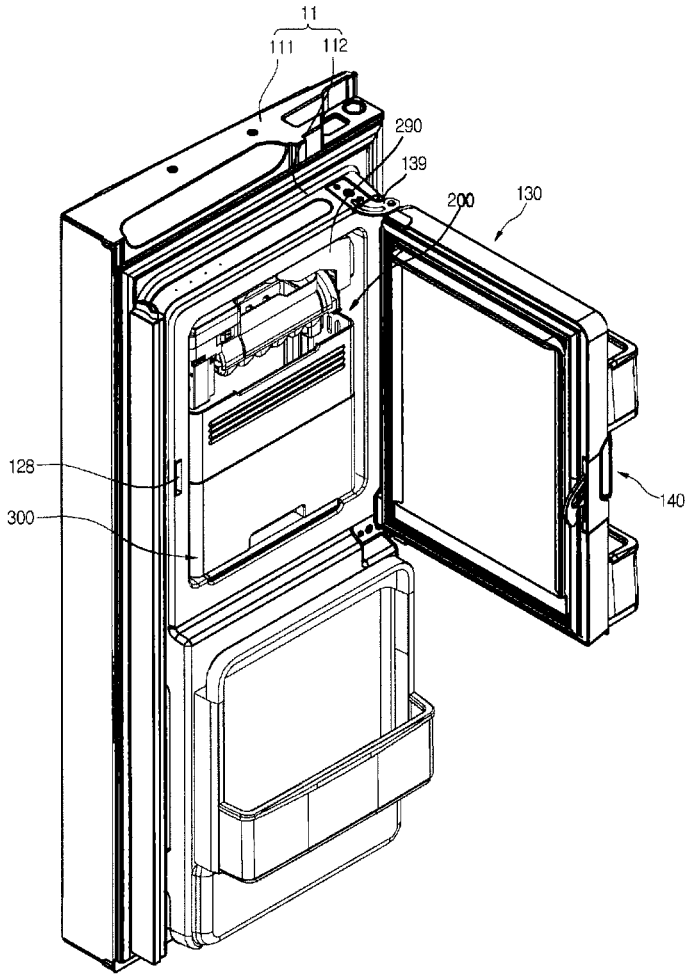
FIG. 3 is a perspective view of a refrigerator compartment door with an ice compartment door opened, according to the embodiment.
Figure 4:
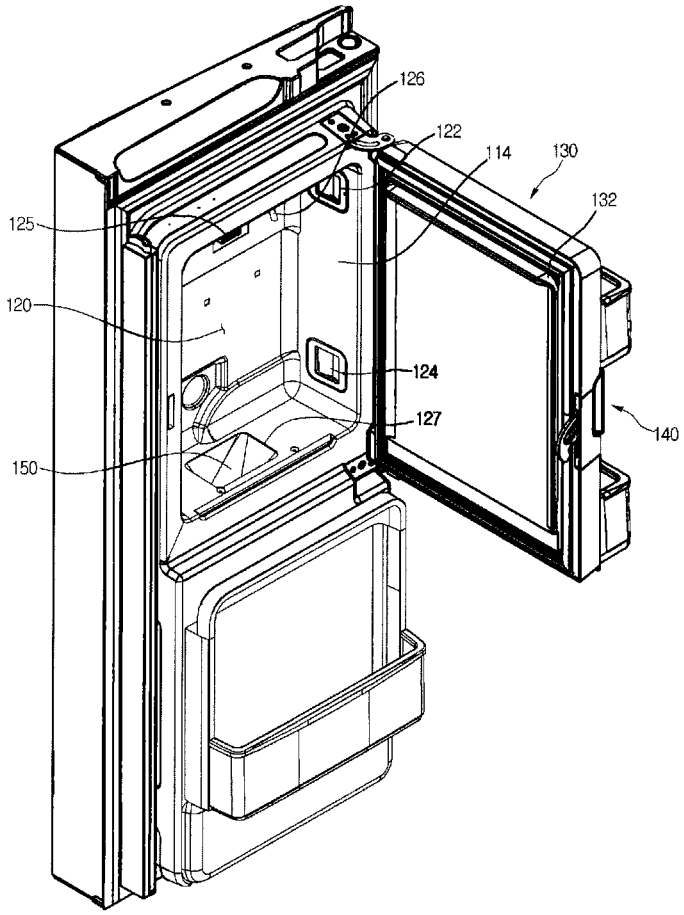
FIG. 4 is a perspective view of the refrigerator compartment door in which an ice making assembly is removed from an ice compartment, according to the embodiment.

FIG. 3 is a perspective view of the refrigerator compartment door with an ice compartment door opened, according to the embodiment. FIG. 4 is a perspective view of the refrigerator compartment door in which the ice making assembly is removed from the ice compartment, according to the embodiment.

Referring to FIGS. 1 to 4, the refrigerator compartment door 11 includes an outer case 111 and a door liner 112 coupled to the outer case 111. The door liner 112 defines a back surface of the refrigerator compartment door 11. An insulation material is disposed between the outer case 111 and the door liner 112.

The door liner 112 defines an ice compartment 120. An ice making assembly 200 for generating and storing ice is disposed inside the ice compartment 120. The ice compartment 120 is opened and closed by an ice compartment door 130. The ice compartment door 130 is rotatably connected to the door liner 112 by a hinge 139. A handle 140 is disposed on the ice compartment door 130 to couple the compartment door 130 to the door liner 112 when the ice compartment 120 is closed by the ice compartment door 130.

A handle coupling part 128 coupled to a portion of the handle 140 is defined in the door liner 112. The handle coupling part 128 receives the portion of the handle 140.

The cabinet 10 includes a main body supply duct 106 for supplying cool air to the ice compartment 120 and a main body return duct 108 for recovering the cool air from the ice compartment 120. The main body supply duct 106 and the main body return duct 108 may communicate with a space in which an evaporator (not shown) is disposed.

The refrigerator compartment door 11 includes a door supply duct 122 for supplying the cool air of the main body supply duct 106 to the ice compartment 120, and a door return duct 124 for recovering the cool air of the ice compartment 120 to the main body return duct 108.

The door supply duct 122 and the door return duct 124 extend from an outer wall 113 of the door liner 112 to an inner wall 114 constituting the ice compartment 120. The door supply duct 122 and the door return duct 124 are vertically arrayed, and the door supply duct 122 is disposed over the door return duct 124. However, in the current embodiment, the positions of the door supply duct 122 and the door return duct 124 are not limited thereto.

When the refrigerator compartment door 11 closes the refrigerator compartment 102, the door supply duct 122 is aligned and communicates with the main body supply duct 106, and the door return duct 124 is aligned and communicates with the main body return duct 108.

The ice compartment 120 is provided with a cool air duct 290 guiding cool air flowing in the door supply duct 122 to the ice making assembly 200. The cool air duct 290 includes a passage through which cool air flows, and cool air flowing in the cool air duct 290 is finally supplied to the ice making assembly 200. Since cool air may be concentrated to the ice making assembly 200 through the cool air duct 290, ice can be rapidly generated.

The refrigerator compartment door 11 includes a first connector 125 for supplying an electric source to the ice making assembly 200. The first connector 125 is exposed to the ice compartment 120. The refrigerator compartment door 11 is provided with a water supply pipe 126 for supplying water to the ice making assembly 200.

The water supply pipe 126 is disposed between the outer case 111 and the door liner 112, its end passes through the door liner 112 and is disposed at the ice compartment 120.

An ice opening 127 for discharging ice is disposed at the lower side of the inner wall 114 of the door liner 112 defining the ice compartment 120. An ice duct 150 communicating with the ice opening 127 is disposed at the lower side of the ice compartment 120.

Figure 5:
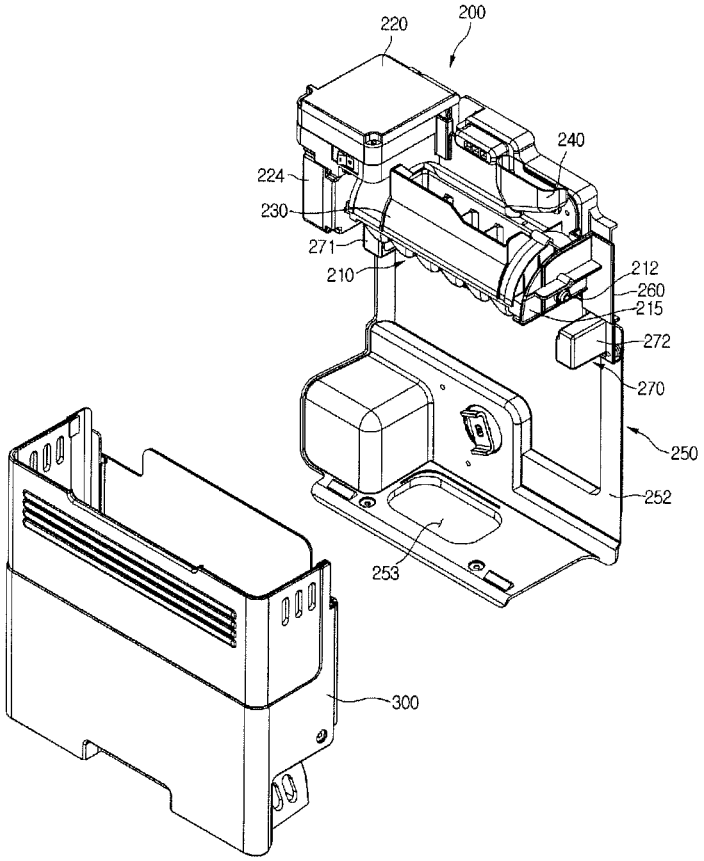
FIGS. 5 and 6 are perspective views of the ice making assembly according to the embodiment.
Figure 6:
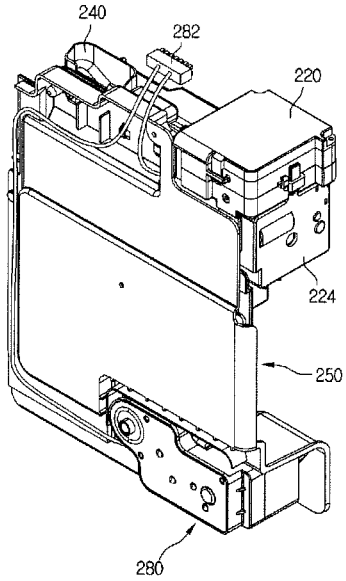

FIGS. 5 and 6 are perspective views of the ice making assembly according to the embodiment.

Referring to FIGS. 3 to 6, the ice making assembly 200 defines a space where ice is generated, and includes an ice maker 210 supporting generated ice, a driving source 220 providing power for automatically rotating the ice maker 210 to remove ice from the ice maker 210, a gear box 224 transmitting the power of the driving source 220 to the ice maker 210, a cover 230 covering the ice maker 210 to prevent the overflow of water when the water is supplied to the ice maker 210, and a water guider 240 guiding water supplied from the water supply pipe 126 to the ice maker 210.

The ice making assembly 200 includes a support mechanism 250 including a seat part 215 on which the ice maker 210 is placed, an ice bin 300 storing ice removed from the ice maker 210, a full ice sensor 270 for sensing full ice state of the ice bin 300, and a motor assembly 280 selectively connected to the ice bin 300.

An electric wire connected to the motor assembly 280 and an electric wire connected to the driving source 220 are connected to a second connector 282 that is removably coupled to the first connector 125.

In detail, the driving source 220 may include a bi-directionally rotatable motor.

The support mechanism 250 includes a first support part 252 and a second support part 260 coupled with the first support part 252.

The first support part 252 is placed on the ice compartment 120. The motor assembly 280 is installed on the first support part 252. An ice opening 253 through which ice discharged from the ice bin 300 passes is disposed in the bottom surface of the first support part 252. The ice bin 300 is placed on the first support part 252. That is, the first support part 252 supports the ice bin 300.

When the ice bin 300 is placed on the first support part 252, the motor assembly 280 is connected to the ice bin 300. In the current embodiment, the state where the ice bin 300 is placed on the first support part 252 means the state where the ice compartment 120 accommodates the ice bin 300.

The seat part 215 on which the ice maker 210 is placed is installed on the second support part 260. The ice maker 210 includes a rotation shaft 212 at a side. The rotation shaft 212 is rotatably coupled to the seat part 215. An extension part (not shown) extending from the gear box 224 is connected to another side of the ice maker 210.

The full ice sensor 270 is installed on the second support part 260 at a position spaced apart from the ice maker 210. The full ice sensor 270 is disposed under the ice maker 210.

The full ice sensor 270 includes a transmission part 271 transmitting a signal, and a receiving part 272 spaced apart from the transmission part 271 and receiving a signal from the transmission part 271. The transmission part 271 and the receiving part 272 are disposed in the inner space of the ice bin 300 when the ice bin 300 is placed on the first support part 252.

Figure 7:
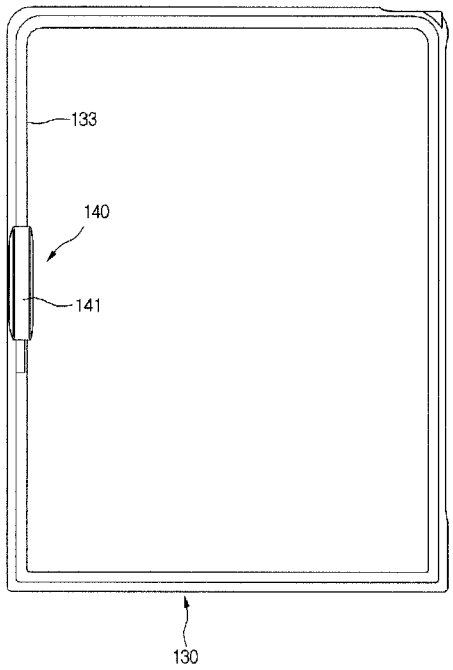
FIG. 7 is a rear view of the ice compartment door according to the embodiment.
Figure 8:
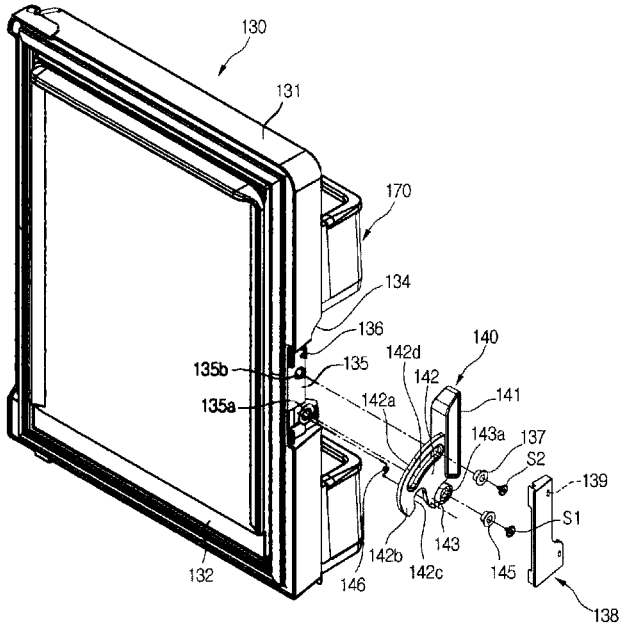
FIG. 8 is a perspective view of the ice compartment door with a cover member and a handle removed, according to the embodiment.
Figure 9:
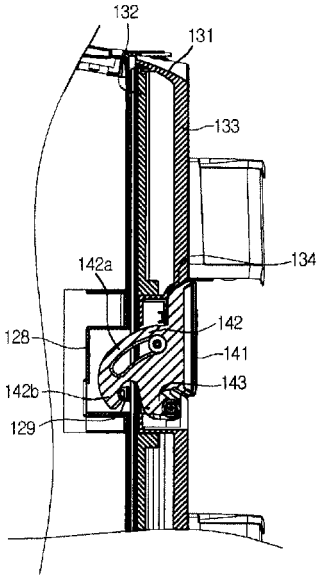
FIG. 9 is a cross-sectional view of a hook member received by a door liner.

FIG. 7 is a rear view of the ice compartment door according to the embodiment. FIG. 8 is a perspective view of the ice compartment door with a cover member and the handle removed, according to the embodiment. FIG. 9 is a cross-sectional view of a hook member received by a door liner.

Referring to FIGS. 3, 7, 8 and 9, the ice compartment door 130 includes an ice compartment door case 131, and an ice compartment door liner 132 connected to the ice compartment door case 131 and covering the ice compartment 120.

A dike 133 is disposed at the edge of the ice compartment door case 131. The dike 133 protrudes from the ice compartment door case 131. One or more baskets 170 may be installed on the dike 133 to store food.

The ice compartment door 130 includes the handle 140 that is held by a user to rotate the ice compartment door 130. The handle 140 is coupled to the refrigerator compartment door 11 when the ice compartment door 130 closes the ice compartment 120.

Thus, the handle 140 fixes the ice compartment door 130 to the position where the ice compartment door 130 closes the ice compartment 120.

The handle 140 is installed on a side surface of the ice compartment door case 131. The ice compartment door case 131 includes an installation part 135 to install the handle 140 on the side surface. The installation part 135 is recessed in the side surface of the ice compartment door case 131.

When the handle 140 is installed on the side surface of the ice compartment door case 131, a cover member 138 is coupled to the ice compartment door case 131. The cover member 138 covers at least one portion of the handle 140.

The handle 140 includes a grip part 141 that is held by a user, and a hook member 142 extended from the grip part 141 and selectively hung on the door liner 112 of the refrigerator compartment door 11.

The dike 133 includes a recessed part 134 having a shape corresponding to the grip part 141 to prevent interference with the grip part 141. The grip part 141 and the dike 133 are disposed on an identical line from a front view of the ice compartment door 130. Thus, the lateral width taken by the handle 140 is decreased to improve the appearance.

The lateral length of the grip part 141 with respect to FIG. 7 may be defined as the thickness of the grip part 141. The thickness of the hook member 142 is less than the thickness of the grip part 141. The thickness of the hook member 142 is less than the thickness of the dike 133.

The hook member 142 is extended in a round shape from the grip part 141. In detail, referring to FIG. 8, the hook member 142 is extended downward in a round shape from the grip part 141 to the ice compartment 120.

Since the hook member 142 has a round shape, the hook member 142 can be easily inserted into a handle coupling part 128 when the handle 140 is rotated.

An extension part 143 extends downward from the hook member 142. The extension part 143 has a shaft through hole 143*a* through which a rotation shaft 145 passes. The ice compartment door case 131 includes a first coupling part 135*a* to couple to the rotation shaft 145. The first coupling part 135*a* protrudes from the side surface of the ice compartment door case 131, and passes through the rotation shaft 145.

In the state where the rotation shaft 145 passes through the shaft through hole 143*a*, the first coupling part 135*a* passes through the rotation shaft 145. Then, a coupling member S1 is coupled to the first coupling part 135*a*. The rotation shaft 145 provides the rotation center of the handle 140.

In the current embodiment, the rotation shaft 145 passes through the extension part 143 to couple to the first coupling part 135*a*, but the extension part 143 may be integrally formed with a rotation shaft.

The rotation center of the handle 140 extends horizontally and crosses the ice compartment door 130 (or the side surface of the ice compartment door case 131). Thus, the handle 140 rotates vertically about the rotation center extending horizontally. The rotation center of the handle 140 is disposed on the extension part 143. In other words, the rotation center of the handle 140 passes through the extension part 143.

Since the handle 140 rotates just back and forth, a space of the ice compartment door 130 for preventing the interference with the handle 140 when the handle 140 rotates can be decreased.

The hook member 142 may rotate within the thickness of the dike 133. The rotation of the hook member 142 may be guided by a guide part 137 that passes through the hook member 142. The ice compartment door case 131 includes a second coupling part 135*b* coupled with the guide part 137.

The second coupling part 135*b* protrudes from the side surface of the ice compartment door case 131, and passes through the guide part 137. In the state where the guide part 137 passes through the hook member 142, the second coupling part 135*b* passes through the guide part 137. Then, a coupling member S2 is coupled to the second coupling part 135*b*.

In the state where the guide part 137 is coupled to the second coupling part 135*b*, the guide part 137 is spaced apart from the rotation shaft 145. Thus, the hook member 142 can be stably rotated by the guide part 137.

The hook member 142 has a guide hole 142*d* through which the guide part 137 passes. Since the hook member 142 is rotatable, the guide hole 142*d* may have a round shape to prevent interference between the hook member 142 and the guide part 137. For example, the guide hole 142*d* may have an arc shape. The periphery of the guide part 137 may be round to facilitate the rotation of the hook member 142.

The hook member 142 includes a first part 142*a* having a round shape with a first curvature, and a second part 142*b* extending from the first part 142*a* and having a round shape with a second curvature greater than the first curvature of the first part 142*a*. The second part 142*b* extends in a round shape from the first part 142*a* to the extension part 143.

A space is disposed between the second part 142*b* and the extension part 143. A surface of the second part 142*b* facing the extension part 143 has a hook surface 142*c* for hooking a hook protrusion to be described later.

In the current embodiment, since the second curvature of the second part 142*b* is greater than the first curvature of the first part 142*a*, when the second part 142*b* hooks the hook protrusion, hooking force and frictional force can be increased.

The ice compartment door 130 includes an elastic member 146 applying elastic force in a direction in which the hook member 142 is received by the handle coupling part 128. The elastic member 146 has an end that may be connected to the ice compartment door case 131, and the other end that may be connected to the extension part 143.

The ice compartment door case 131 includes a catching part 136 to which a protrusion 139 provided to the cover member 138 is caught. Since the cover member 138 is coupled to the side surface of the ice compartment door case 131, the degradation in the appearance of the ice compartment door 130 can be prevented.

The handle coupling part 128 provided to the door liner 112 is recessed from the rear surface of the door liner 112 to the front surface of the outer case 111. The handle coupling part 128 includes a hook protrusion 129 hooked by the hook member 142.

The second part 142*b* of the hook member 142 pulls the hook protrusion 129 in the state where the second part 142*b* is received by the handle coupling part 128. Thus, the gap between the door liner 112 and the ice compartment door 130 can be minimized.

Hereinafter, a process of opening and closing the ice compartment will now be described.

In the state where the ice compartment 120 is closed by the ice compartment door 130, the grip part 141 is held and pulled. Then, the handle 140 is rotated about the rotation shaft 145, and the second part 142*b* of the hook member 142 is released from the handle coupling part 128. Accordingly, the ice compartment door 130 can be rotated.

To close the ice compartment 120, the second part 142*b* of the hook member 142 is aligned with the handle coupling part 128 in the state where the grip part 141 is pulled. Thereafter, the handle 140 is pushed toward the refrigerator compartment door 11 in the state where the grip part 141 is held. Then, the second part 142*b* of the hook member 142 is rotated and inserted into the handle coupling part 128. When the insertion of the second part 142*b* is completed, the hook surface 142*c* of the second part 142*b* is hung on the hook protrusion 129.

According to the embodiments, the rotation center of the handle crosses the side surface of the ice compartment door case, and the handle is disposed on the extension line of the dike. Thus, the space for preventing the interference with the handle can be reduced.

In addition, since the grip part and the dike are disposed on an identical line, the lateral width taken by the handle is decreased to improve the appearance.

In addition, the handle is installed on the side surface of the ice compartment door, and the cover member covers the handle. Thus, the degradation in the appearance of the ice compartment door can be prevented.

In addition, since the guide part guiding the rotation of the handle is spaced apart from the rotation shaft, the handle can be stably rotated.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a refrigerator compartment;

a refrigerator door configured to open and close the refrigerator compartment;

an ice compartment provided on the refrigerator door;

an ice compartment door hinged on the refrigerator door;

at least one basket mounted on the ice compartment door;

a dike that protrudes from an edge of the ice compartment door to define a side wall of the at least one basket and that comprises a recessed part in the dike;

a handle configured to lock the ice compartment door to the refrigerator door, the handle comprising a grip part and an extension part that selectively couple the ice compartment door to the refrigerator door, the grip part being disposed in and having a shape corresponding to the recessed part in the dike that defines the side wall of the at least one basket;

an ice maker that is located within the ice compartment and that is turned over by a rotation operation to separate ice cubes from the ice maker due to weight of ice cubes made by the ice maker;

an ice bin detachably mounted in the ice compartment and disposed below the ice maker;

a motor assembly selectively connected to the ice bin and mounted on the refrigerator door; and a dispenser provided on the refrigerator door and configured to communicate with the ice bin.

2. The refrigerator according to claim 1, wherein the handle comprises a hook provided on an end portion of the extension part in order to selectively engage with a hook protrusion provided on the refrigerator door by rotational movement of the handle, and the hook moves within a thickness of the dike.

3. The refrigerator according to claim 2, wherein the hook is inserted into the refrigerator door along a back-and-forth direction of the ice compartment door.

4. The refrigerator according to claim 2, wherein the extension part extends in a round shape from the grip part.

5. The refrigerator according to claim 4, wherein the extension part is provided with a rotation shaft providing a rotation center of the handle.

6. The refrigerator according to claim 2, wherein the ice compartment door comprises a guide part guiding a movement of the handle.

7. The refrigerator according to claim 6, wherein the handle has a guide hole through which the guide part passes.

8. The refrigerator according to claim 7, wherein the extension part is extended in a round shape from the grip part, and the guide hole is round.

9. The refrigerator according to claim 6, wherein the ice compartment door comprises a coupling part coupled with the guide part, and the guide part is coupled to the coupling part at a position spaced apart from a rotation center of the handle.

10. The refrigerator according to claim 9, wherein the rotation center of the handle is positioned below the guide part.

11. The refrigerator according to claim 9, wherein the ice compartment door comprises an installation part on a side surface, the handle is installed on the installation part, and the coupling part is provided to the installation part.

12. The refrigerator according to claim 1, wherein the handle is rotatably coupled to a side surface of the ice compartment door.

13. The refrigerator according to claim 12, further comprising a cover member covering the handle when the handle is coupled to the ice compartment door.

14. The refrigerator according to claim 1, wherein a rotation center of the handle crosses a side surface of the ice compartment door.

15. The refrigerator according to claim 14, wherein the extension part comprises a first part having a round shape with a first curvature from the grip part; and a second part having a round shape with a second curvature from the first part, wherein the second curvature is greater than the first curvature.

16. The refrigerator according to claim 1, wherein the ice compartment door comprises a hinge, and wherein the ice compartment door is rotatably connected to a door liner by the hinge.

* * * * *

UNITED STATES PATENT AND TRADEMARK OFFICE

CERTIFICATE OF CORRECTION

PATENT NO. : 8,627,678 B2
APPLICATION NO. : 12/730283
DATED : January 14, 2014
INVENTOR(S) : Sang Phil Choi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 572 days.

Signed and Sealed this
Thirtieth Day of May, 2017

Michelle K. Lee

Michelle K. Lee
*Director of the United States Patent and Trademark Office*